US007996922B2

(12) United States Patent
Ross et al.

(10) Patent No.: US 7,996,922 B2
(45) Date of Patent: Aug. 16, 2011

(54) CUFF FOR STORING OBJECT AROUND WRIST

(75) Inventors: Theodor Ross, Princeton Junction, NJ (US); Heidi Kleinman, Princeton Junction, NJ (US)

(73) Assignee: South Mill Design, LLC, Princeton Junction, NJ (US)

( * ) Notice: Subject to any disclaimer, the term of this patent is extended or adjusted under 35 U.S.C. 154(b) by 697 days.

(21) Appl. No.: 12/001,592

(22) Filed: Dec. 12, 2007

(65) Prior Publication Data

US 2009/0158500 A1 Jun. 25, 2009

(51) Int. Cl.
*A41D 20/00* (2006.01)

(52) U.S. Cl. ..... 2/170

(58) Field of Classification Search ..... 2/162, 170
See application file for complete search history.

(56) References Cited

U.S. PATENT DOCUMENTS

| | | | | |
|---|---|---|---|---|
| D259,220 | S | 5/1981 | Small | |
| 4,462,116 | A | 7/1984 | Sanzone | |
| D280,255 | S | 8/1985 | Blaivas | |
| 4,913,326 | A | 4/1990 | Echelson | |
| 5,329,638 | A | 7/1994 | Hansen | |
| D354,840 | S | 1/1995 | Geisler | |
| 6,105,837 | A | 8/2000 | Teed | |
| 6,349,414 | B1 | 2/2002 | Tillman | |
| 6,418,563 | B1 * | 7/2002 | Turner | 2/239 |
| 6,425,137 | B1 * | 7/2002 | Fakhrai | 2/170 |
| 2004/0173648 | A1 | 9/2004 | Avazpour | |
| 2006/0124675 | A1 | 6/2006 | Calicott | |
| 2006/0186150 | A1 | 8/2006 | Willows | |
| 2006/0261108 | A1 | 11/2006 | Watts | |
| 2007/0083979 | A1 * | 4/2007 | Daniels | 2/160 |
| 2007/0170216 | A1 | 7/2007 | Davis | |

* cited by examiner

*Primary Examiner* — Katherine Moran

(57) ABSTRACT

A method of making a cuff by obtaining a piece of flexible material in the shape of a rectangle having first and second longitudinal edges, front and back faces, and first and second latitudinal edges; folding over the first and second latitudinal edges to meet the parallel fold lines; uniting the latitudinal edges to the fold lines to form first and second hems; folding a first half of the flexible material back over a second half of the flexible material along the third fold line so that the front face is on the interior and hems are on the exterior forming a tube; uniting the first and second longitudinal edges to form a flat tube having a closed tube edge, which is divided into a first closed tube edge and a second closed tube edge; folding the first closed tube edge over the second closed tube edge along a fourth fold line, which is perpendicular to the closed tube edge, so that the second hem is brought adjacent to but does not overlap the first hem to form a folded flattened tube; uniting the first closed tube edge over the second closed tube edge; turning the folded flattened tube inside out to form a cuff so that the front face forms an exterior surface of the cuff.

5 Claims, 4 Drawing Sheets

FIGURE #1
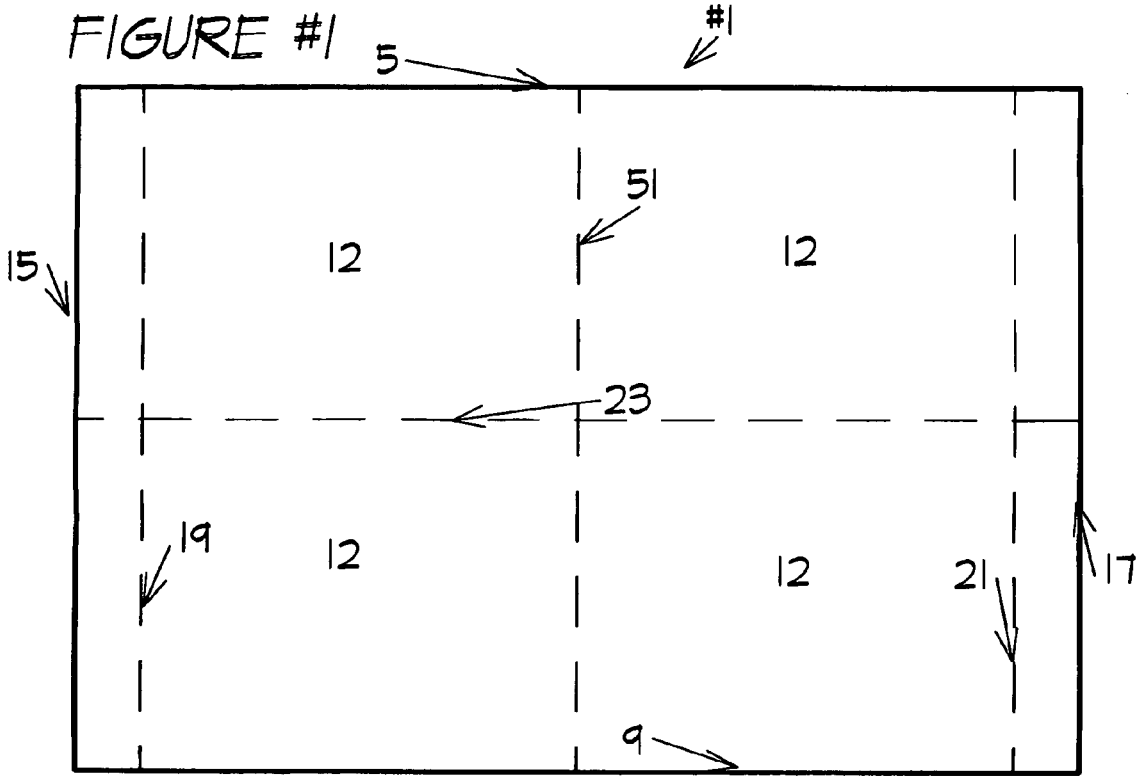
FIGURE #2
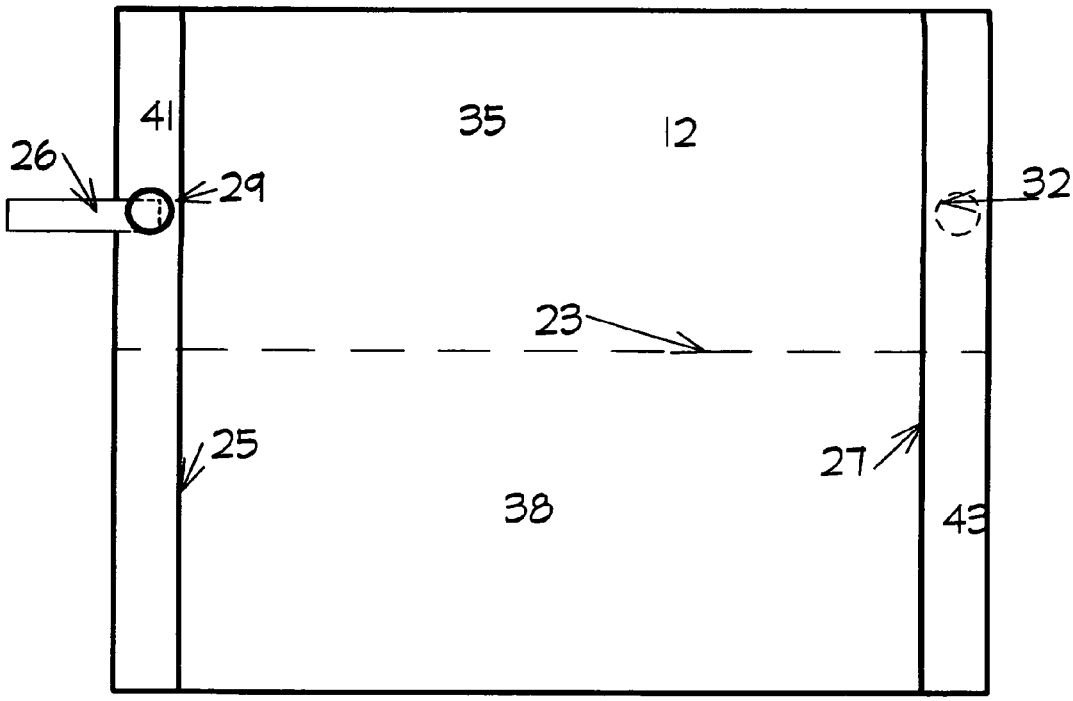

FIGURE #3
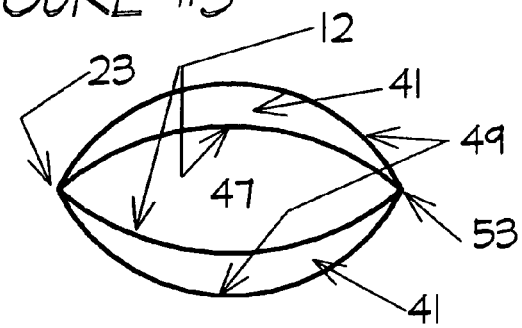
FIGURE #4
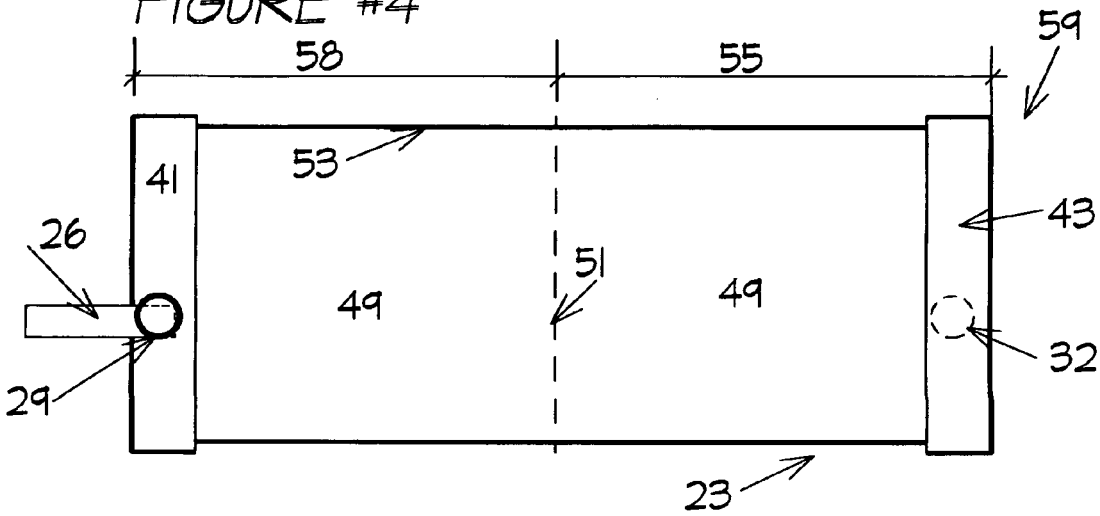
FIGURE #5
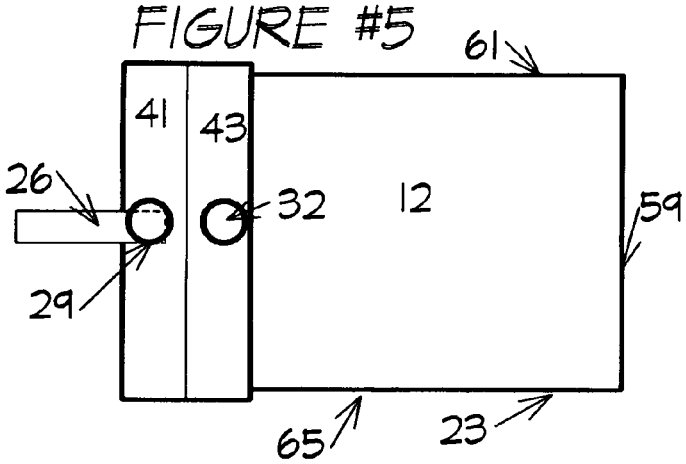

FIGURE #6
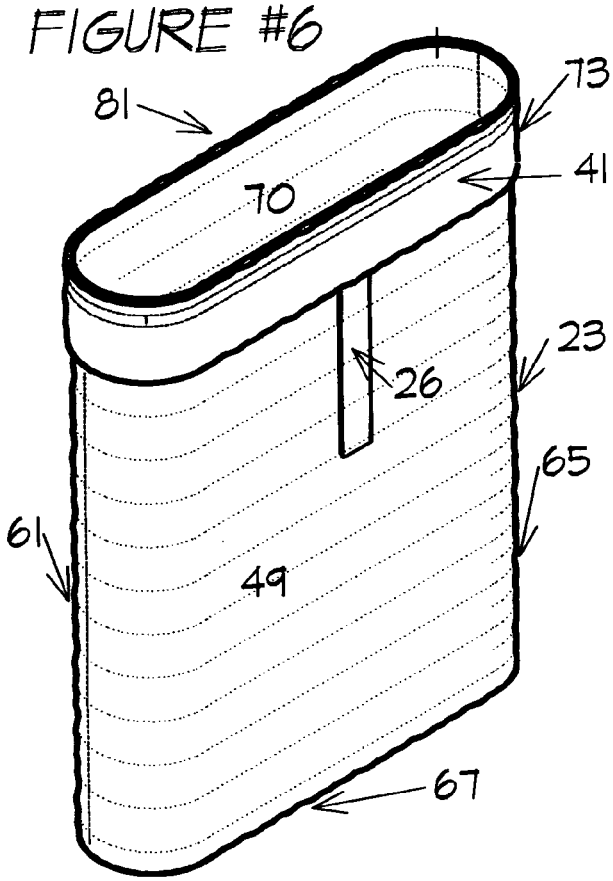
FIGURE #7
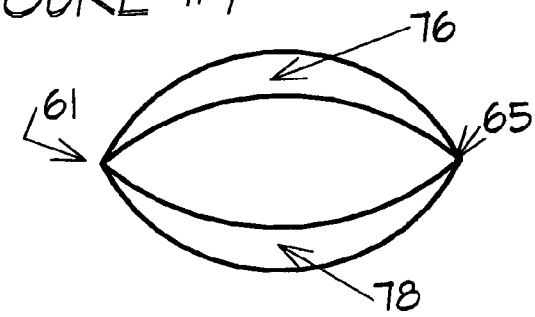

FIGURE #8
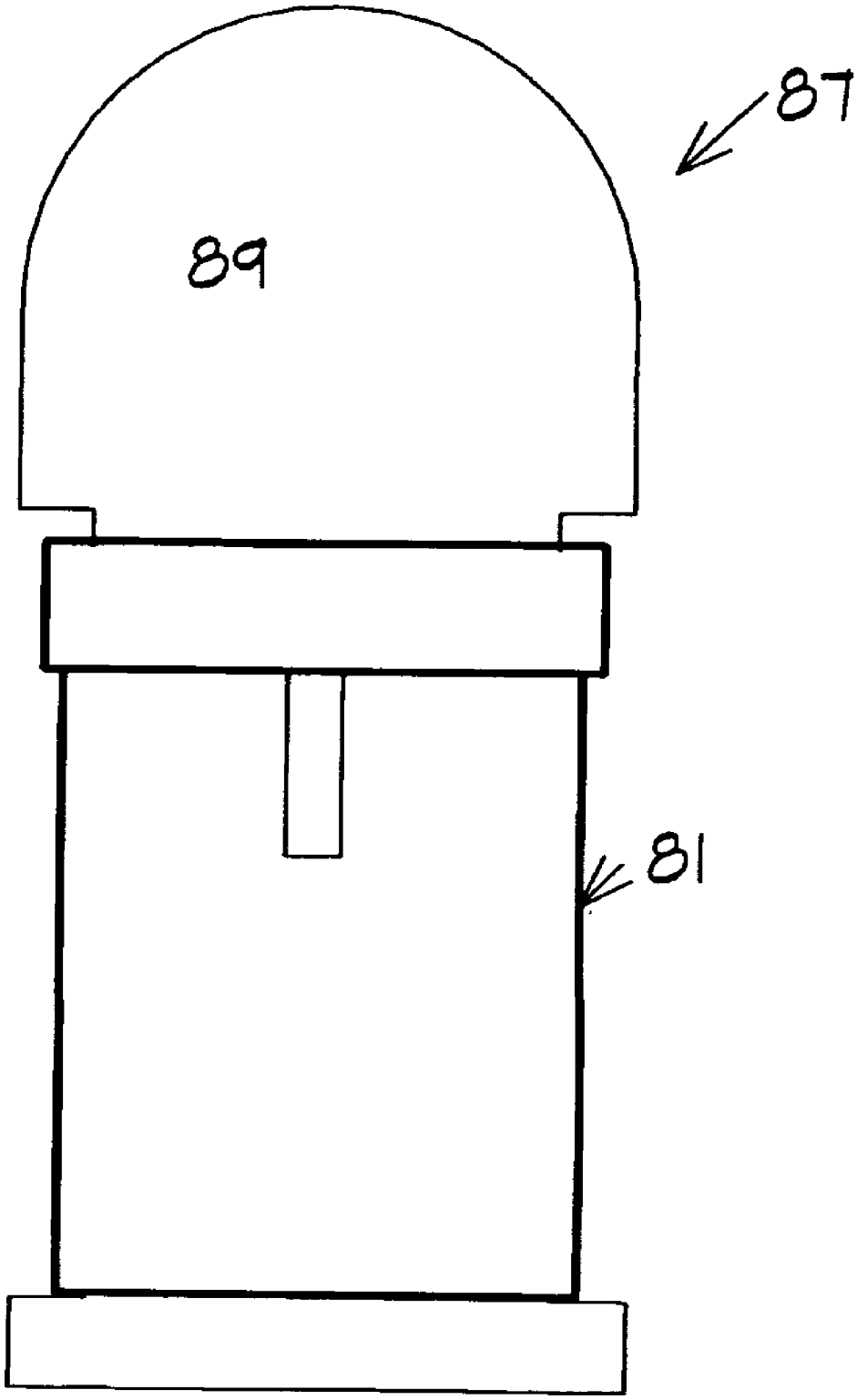

CUFF FOR STORING OBJECT AROUND WRIST

BACKGROUND OF THE INVENTION

Unless routinely carried by its user, a cell phone's functionality and utility are lost to the owner. For a large segment of the population, the device is now an indispensable communications tool. With the approaching universality of the cell phone, the techniques, tools, and accessories currently developed to carry a phone have been limited. While the accessories that have been created have solved some functional issues for the user, each approach has also brought specific user disadvantages.

Individuals employ various approaches, including cell phone accessories, when using or storing their phone. A clip attached to one's belt loop or handbag is the most commonly used accessory. The clip allows users to free up their hands and allows for a quick retrieval of the phone when receiving an incoming call. The disadvantage of this approach is evident when a phone's ring-tone has been muted and the vibrate setting is engaged to alert the user to an incoming call or message. Because the device is not in direct contact with the user's body, the vibration of the phone is difficult to detect. In addition, the phone is often accidentally damaged because it is vulnerable to being hit. When people are active, either with their work or in recreation, a phone clip worn on one's waist is often inadequate to protect the phone. The phone is easily knocked or banged.

The basic and most often used approach to carrying a cell phone is simply in one's pocket (pants, coat, etc.), handbag or briefcase. Women's clothing—dresses, skirts—is typically not designed to allow the use of a cell phone holder or clip so women are even more likely to rely on this method. No accessory is employed. But as phones get buried in an article of clothing or a bag, it is more likely that a ring-tone is not heard or the vibrate mode is not detected. Because of these critical limitations, many people are driven to carry their phone in their hand. Cell phone users who actively send and receive text messages or are in social or work settings where a ringing phone is inappropriate are forced to keep the phone in their palm. While it is an obvious inconvenience for the user to have to hold the phone in hand, doing so minimizes the possibility of missed messages, or awkward searches for a phone buried in a bag or briefcase. Users who carry their phone in hand, are also more likely to misplace the device because they are often required to set down the device when both hands are required for a task.

Accordingly, there is a need in the art for improved storage of hand-held electronic devices, like cell phones, mp3 players and other such devices, by users who primarily rely on holding their phone in their hand.

BRIEF SUMMARY OF THE INVENTION

The present invention relates to a method of making a cuff comprising the steps of: obtaining a piece of flexible material in the shape of a rectangle having first and second longitudinal edges, front and back faces, and first and second latitudinal edges; folding over the first and second latitudinal edges to meet the parallel fold lines; uniting the latitudinal edges to the fold lines to form first and second hems; folding a first half of the flexible material back over a second half of the flexible material along the third fold line so that the front face of the fabric is on the interior; uniting the first and second longitudinal edges to form a flat tube having a closed tube edge, which is divided into a first closed tube edge and a second closed tube edge; folding the first closed tube edge over the second closed tube edge along a fourth fold line, which is perpendicular to the closed tube edge, so that the second tube is brought adjacent to but does not overlap the first tube to form a folded double-layered flattened tube; uniting the first hem over the second hem; turning the folded flattened tube inside out to form a cuff so that the front face forms an exterior surface of the cuff.

The present invention also relates to a cuff for storage around the wrist comprising: flexible material in the shape of a rectangle; first and second fastening devices; and wherein the flexible material is formed in the shape of a double-layered tube having open distal and proximal ends, and first pocket and second pocket; and wherein the first and second fastening devices are attached adjacent to the proximal end.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown in the drawings.

FIG. 1 is a top view of a piece of flexible material 1.

FIG. 2 is a top view of the folded piece of flexible material 1.

FIG. 3 is an enlarged sectional side view of the piece of flexible material 1 illustrating the fold of the piece of flexible material 1 around the first fold line 23.

FIG. 4 is a side view of the flattened tube 59 formed by previous folding steps.

FIG. 5 is a side view of the flattened tube 59 illustrating the fold of the flattened tube 59 around the fourth fold line 51.

FIG. 6 is a perspective view of the cuff.

FIG. 7 is a sectional side view of the cuff.

FIG. 8 is a front view of the packaging strip 87 and cuff 81.

DETAILED DESCRIPTION OF THE INVENTION

The present invention relates to a wearable flexible cuff meant for securely holding an object such as an electronic device to the wrist of the wearer. Holding or storing the object to the wrist of the cell phone user allows the user to quickly access an incoming call or message and allows the user to readily detect a ring-tone or phone set to vibrate mode. In addition, the flexible cuff protects the phone against damage or loss and is comfortable for the full length of time that a phone is carried during a day. Finally the cuff is able to accommodate the varying sizes and shapes employed by various manufactures of cell phones and other electronic devices.

The construction and use of the device of this invention are described in more detail hereinafter. Such disclosure is by way of illustration and not limitation of the invention herein.

Although not necessary or essential to the present invention, it is preferable to prepare the flexible cuff by a folding process described as follows with specific reference to the accompanying figures.

FIG. 1 shows a piece of flexible material 1 in the shape of a rectangle having a front face 12 and a back face (not shown), first and second longitudinal edges 5, 9 and first and second latitudinal edges 15, 17. (Suitable fabric materials are discussed in greater detail, below). Parallel to the first and second latitudinal edges 15, 17 are first and second fold lines 19, 21 and perpendicular to these latitudinal edges is a third fold line 23. These fold lines may be imaginary or may be real fold lines pressed out after the stamping or cutting out of the flexible material 1. As a first step in forming the flexible cuff the first and second latitudinal edges 15, 17 are folded over and united at lines 19, 21 (suitable techniques for "uniting" include stitching such as with a zig-zag stitch or other techniques known to persons of ordinary skill in the art) to form first and second hems 41, 43. Referring to FIG. 2, thread sections 25 and 27 now shown along the lines previously denoted as the first and second fold lines 19, 21. A first fastening device 29 is preferably attached to the first hem 41 and is visible in FIG. 2. Also visible in FIG. 2 is a finger ribbon 26 whose use is described in greater detail below. A second fastening device 32 is attached to the back face of the sheet under the second hem 43 (the location of the second fastening device is shown in broken lines). Suitable fastening devices are discussed in greater detail below.

Next, a first half of the flexible material 38 is folded back over a second half 35 along a third fold line 23 so that the front face 12 is on the interior and hems 41, 43 are on the exterior and the back face 49 forms the interior tube 47, and the flexible material is in the shape of a flattened tube as shown in FIGS. 3 and 4 (FIG. 3 is enlarged for purposes of clarity; in actual size it will more likely shows its conformation as a flattened tube). The first longitudinal edge 5 is then united to the second longitudinal edge 9 to form a closed tube edge 53. This creates a continuous tube edge 53 equally divided to create a first closed tube edge 55 and a second closed tube edge 58.

Next, the first hem 41 is folded over the second hem 43 along a fourth fold line 51 so that the second hem 43 is brought adjacent to but does not overlap the first hem 41 to create a folded flattened tube as shown in FIG. 5. The first hem 41 is then folded down over the second hem 43 (this action is not shown in this figure). The first closed tube edge 55 is united to the second closed tube edge 58 to create the seam 61. Additionally, another seam 65 is stitched into the third fold line 23. With the exterior surface 12 on the outside of the flexible fabric layer the first fastening device 29 can be connected to the second fastening device 32 to form the cuff 81 illustrated in FIGS. 6 and 7.

As can be seen in FIGS. 6 and 7, the cuff 81 is in the shape of a double-layered tube. It is intended that a hand is inserted first into the distal end 67 and then through the proximal end 70. This cuff 81 has a first pocket and a second pocket 76, 78 located between the layers, created by the action of the stitching and folding described above, each pocket having entry slits (not shown) allowing electronic devices or other objects to be slipped into the first pocket and second pocket. The first pocket 76 and the second pocket 78 are separated from each other by the seams 61 and 65; these seams also act to prevent the electronic device from sluicing around the circumference of the cuff and wrist. Additionally, the first hem 41 folded over the second hem 43 as described above, which creates a flap 73 that prevents an object inserted into either the first pocket or second pocket from coming out. Additionally, there are mating first and second fastening devices 29, 32 (not shown in FIG. 6 or 7) to secure the object inside the first pocket 76.

As mentioned above, the cuff 81 is in the shape of a double-layered tube it is intended that a hand is inserted first into the distal end 67 and then through the proximal end 70. Also at the proximal end is the ribbon 26, which performs an important function in facilitating easy access to the object in the cuff by utilizing the following procedure:

(1) slip a cuff hand and wrist into distal end then proximal end of cuff with the cuff fitting snugly around the wrist;

(2) hold an object, such as a cell phone or mp3 player, with the cuff hand;

(3) use a second hand to open the first pocket, preferably utilizing a ribbon attached to the proximal end of cuff;

(4) slide the object into the pocket (5) secure the first fastening device and second fastening devices.

The cuff is made from an expandable fabric such as a nylon/spandex or Lycra® blend and is made in several different sizes depending on the size of the wearer's wrist. Because the cuff is made from an expandable fabric material and is made in certain specific sizes, the cuff clings tightly to the wearer's wrist and so also holds objects like electronic devices in place, preventing unwanted movement of the device. Additionally if the electronic device is a cell phone, holding it close to the wrist allows the wearer to immediately sense a vibrating cell phone when the cell phone is positioned in silent operating mode.

The fastening devices used herein are reusable mechanical fasteners. Any reusable mechanical fastener or fastening means can be used. Non-limiting examples include: fasteners wherein said first and second fastening devices together comprise a hook and loop (VELCRO®-type) fastener; fasteners wherein said first and second fastening devices, together, comprise a hook and string fasten; fasteners wherein said first and second fasteners together comprise a toggle-type fasteners; fasteners wherein said first and second fastening devices, together, form a snap-type fastener; as well as hook and eye fasteners and the like, so long as the fastener will not damage the fabric of the cuff, the objects contained inside the cuff (such as a cell phone or other electronic device) or the wearer of the cuff.

Optionally, the cuff may be included as an element of a kit when accompanied by instructions and/or packaging so as to be sold in a consumer product or retail environment. One embodiment of this is shown in the packaging 87 in FIG. 8. In this embodiment, the packaging is shown as a strip 87 (preferably made of cardboard or paperboard, for example common label stock). The strip has a front side 89 and a back side (not shown). A variety of indicia may be printed on the front side 89 or back side (not shown) including graphics, symbols, and script lettering (such as instructions, an appropriate trade name, advertising copy or other promotional indicia). The strip may be constructed so as to be amenable to hanging in a hanging display mode. The strip may be designed differently as well, the aforementioned division of portions are meant as examples only.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method of making a cuff comprising the steps of:

obtaining a piece of flexible material in the shape of a rectangle having first and second longitudinal edges, front and back faces, and first and second latitudinal edges;

folding over the first and second latitudinal edges to meet parallel fold lines;

uniting the latitudinal edges to the fold lines to form first and second hems;

folding a first half of the flexible material back over a second half of the flexible material along the third fold line so that the front face is on the interior and hems are on the exterior forming a flat tube;

uniting the first and second longitudinal edges to form a flat tube having a closed tube edge, which is divided into a first closed tube edge and a second closed tube edge;

folding the first closed tube edge over the second closed tube edge along a fourth fold line, which is perpendicular to the closed tube edge, so that the second hem is brought adjacent to but does not overlap the first hem to form a folded flattened tube;

uniting the first closed tube edge over the second closed tube edge;

turning the folded flattened tube inside out to form a cuff so that the front face forms an exterior surface of the cuff.

2. The method of claim 1, wherein mating first and second fastening devices are attached to the piece of flexible material.

3. The method of claim 1, wherein the flexible material comprises a mixture of nylon and spandex.

4. The method of claim 1, wherein a finger ribbon is attached to the piece of flexible material.

5. The method of claim 2, wherein the mating first and second fastening devices are hook and loop fasteners.

* * * * *